US005404757A

United States Patent [19]

Soulard

[11] Patent Number: 5,404,757

[45] Date of Patent: Apr. 11, 1995

[54] DEVICE FOR DRIVING RODS USED PRIMARILY FOR SOIL MECHANICS TESTS INTO THE GROUND

[75] Inventor: Paul J. Soulard, Saint Melaine, France

[73] Assignee: Etat Francais represented by Laboratoire Central des Ponts et Chaussees, Paris, France

[21] Appl. No.: 278,568

[22] Filed: Jul. 21, 1994

Related U.S. Application Data

[63] Continuation of Ser. No. 924,071, Sep. 15, 1992, abandoned.

[30] Foreign Application Priority Data

Mar. 20, 1990 [FR] France ..... 09 03562

[51] Int. Cl.[6] ..... E21B 19/22

[52] U.S. Cl. ..... 73/784

[58] Field of Search ..... 73/84, 784, 866.5, 864.43, 73/864.45, 865.8; 254/134.3 R, 134.3 FT, 134.3 SC; 405/184, 154; 175/39, 40, 50, 162, 170, 172, 203; 166/77

[56] References Cited

U.S. PATENT DOCUMENTS

| | | | |
|---|---|---|---|
| 1,939,796 | 12/1933 | Spowart | 254/134.3 FT |
| 3,054,285 | 9/1962 | Roosen | 175/19 |
| 3,116,793 | 1/1964 | McStravick | 166/77 |
| 3,401,749 | 9/1968 | Daniel . | |
| 3,559,905 | 2/1971 | Palynchuk | 166/77 |
| 4,454,999 | 6/1984 | Woodruff | 254/134.3 FT |
| 4,589,796 | 5/1986 | Newling . | |
| 4,644,791 | 2/1987 | Sonoda et al. | 254/134.3 FT |
| 4,726,239 | 2/1988 | Boggess et al. . | |
| 5,133,405 | 7/1992 | Elliston | 166/77 |

FOREIGN PATENT DOCUMENTS

| | | |
|---|---|---|
| 266206 | 5/1988 | European Pat. Off. . |
| 98343 | 6/1961 | Netherlands . |

*Primary Examiner*—Robert Raevis
*Attorney, Agent, or Firm*—Marshall & Melhorn

[57] ABSTRACT

A Device for driving rods used primarily for soil mechanics tests into the ground, of the type comprising a traction and compression resistant tubular one-piece rod (42) made of a material and capable of being curved by reversible elastic derformation, a drum (44) for winding said rod (42) and a device (46) for driving and extracting said rod.

11 Claims, 4 Drawing Sheets

DEVICE FOR DRIVING RODS USED PRIMARILY FOR SOIL MECHANICS TESTS INTO THE GROUND

This application is a continuation of application Ser. No. 07/924,071, filed Sep. 15, 1992, (now abandoned).

The present invention relates to a device for driving rods used primarily for soil mechanics tests into the ground.

The known devices use straight rods, usually tubular and made of metal, in order to resist compression and traction forces, formed in sections of between one and several in length.

The rod sections are typically joined end to end, usually by screwing, as they are driven into the ground. In order to connect electrically the sensors fixed on the section of rod driven in the first instant and measuring instruments arranged on the ground surface, it is appropriate to provide electrical cables of sufficient length, on which the rod sections are threaded one after the other.

The rod sections must be stowed on an adequate support, handled one after another, screwed end to end whilst being driven, then unscrewed and stowed away again during extraction.

Such devices have various disadvantages:

1) the prior threading of sections on the electric cable is a long and fastidious operation, and may cause fracturing or damage to the cable;
2) the screw connection of the tube rods is relatively fragile, particularly with regard to the rod sections driven in last, which support the maximum extraction force;
3) the automation of different manoeuvres: stocktaking, screwing, driving, extracting, unscrewing and storing away, cannot be practically envisaged, unless complex and costly devices are designed.
4) the set of manoeuvres requires several operations and takes a considerable amount of time, increased by a number of non-productive periods which cannot be eliminated;
5) the driving or extracting operations are necessarily performed discontinuously;
6) incipient fractures, usually at the level of the screwed connections, cannot practically be the subject of early detection.

To alleviate these disadvantages it has been proposed to use a one-piece rod able to be stored on a drum.

European document EP 0 266 206 notably proposes a device for driving a one-piece rod into the ground unwound from a drum supported by a chassis.

The device comprises a rod straightening device and a driving apparatus arranged upstream of the straightening device. The rod used is a metal rod coated in copper which for driving requires a permanent deformation, hence a considerable constraint. It is mentioned in this document that the operation of the driving device can be reversed to enable extraction of the rod. However, this document does not mention how the rod is wound back onto the drum, which would need a reverse permanent deformation with an equally high constraint. These permanent deformations in either direction are incompatible with the use of the rod in a large number of cycles.

The aim of the present invention is to propose a driving and extracting device which is provided with a rod enabling a large number of driving and extracting cycles to be performed.

The aim is achieved by the fact that the rod used is made of composite material at once sufficiently rigid to be able to withstand and transmit longitudinal driving and extracting forces, and sufficiently flexible to enable the rod to be wound on a large radius drum.

The invention relates more particularly to a device for driving rods used primarily for soil mechanics tests into the ground, of the type comprising a one-piece rod resistant to traction and compression, a drum for winding said rod, a device for driving and extracting said rod and a chassis supporting said winding drum and said driving and extracting device, said drum being presented in the form of an annular gutter open towards the exterior, characterized in that said rod is presented in the form of a tube housing along its full length electric and/or optic cables, and/or electric and/or pneumatic conduits, in that the rod is made of a composite material comprising high resistance fibers buried in a bonding material and is capable of being curved by reversible elastic deformation, and, in that said device comprises, in addition, a winding motor supported by the chassis and exerting on the drum a torque directed in the winding direction of the rod, said motor being designed to compensate the spring effect of the rod.

The diameter of the rod and its components are chosen in accordance with the maximum diameter possible of the drum, in such a way that no irreversible deformation of the rod can occur while it is being wound onto the drum.

The free end of the rod is naturally adapted to receive a probe or any other measuring instrument.

Thanks to this rod structure, the rod can be used many times. The device can be handled by only one person, the winding motor enabling the rod to be uncoiled as it is driven into the ground, and to be rewound automatically during the rod extraction phase.

The electric cables or other data or motor energy transmission means are mounted in the rod, either in a central passage arranged in the rod, or buried in the constituent material thereof.

Further, one or more elements, such as electrical conductors can be buried in the rod, so as to enable rapid detection of incipient fractures thereof.

The other details and features of the invention will become clearly apparent when reading the description which follows, with reference to the attached drawings, in which.

Figure 1:
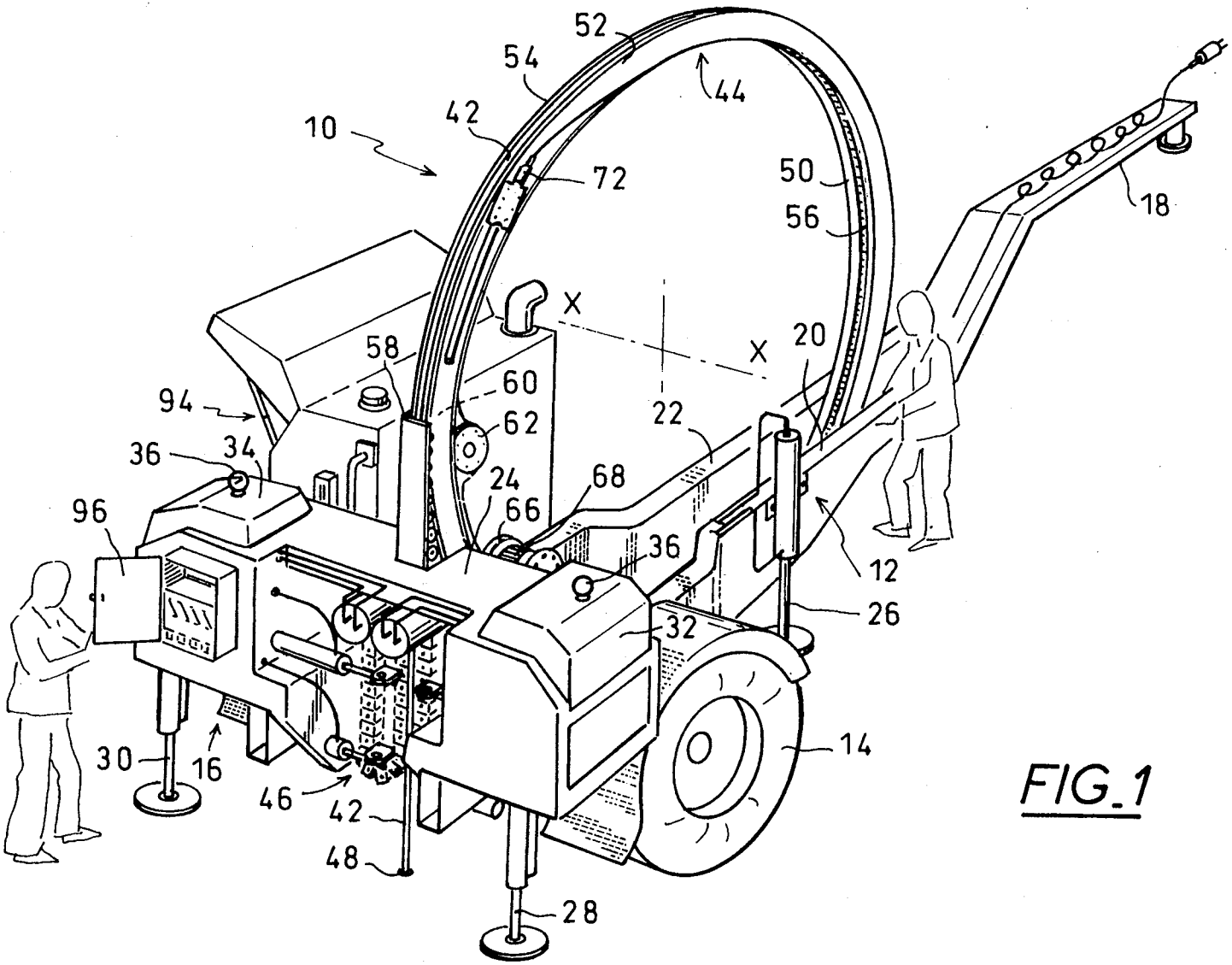
FIG. 1 is a perspective view of a device according to the invention.

The rod driving apparatus, designated in it entirety by the reference 10 in FIG. 1, is mounted on a trailer 12 provided with wheels 14, 16 for transport on roads or other types of ground, and a draw bar 18 for trailing it by a traction vehicle not shown.

As a variant, not shown, the device can be mounted on a suitable automotive vehicle which comprises ground transport means, such as wheels or even tracks.

As will be seen, the trailer carries all elements necessary to autonomous operation of the rod driving device.

The trailer 12 comprises an elongate shape chassis comprising substantially two longitudinal beams 20, 22 set slightly apart, which are fixed at the front on the draw bar 18 and at the rear on a transverse support structure 24. Both beams rest on the wheel shaft by any means known to the expert in the field.

In order to set the trailer in a horizontal position, and resist crushing forces, the trailer comprises three telescopic feet 26, 28 30 actuated by jacks, or as a variant actuated manually.

The front stand 26 is situated towards the middle of the longitudinal beams of the chassis, and two rear feet 28, 30, respectively right and left, are situated under the lateral extensions of the transverse support structure which extends on the right and left beyond the beams 20, 22.

Figure 3:
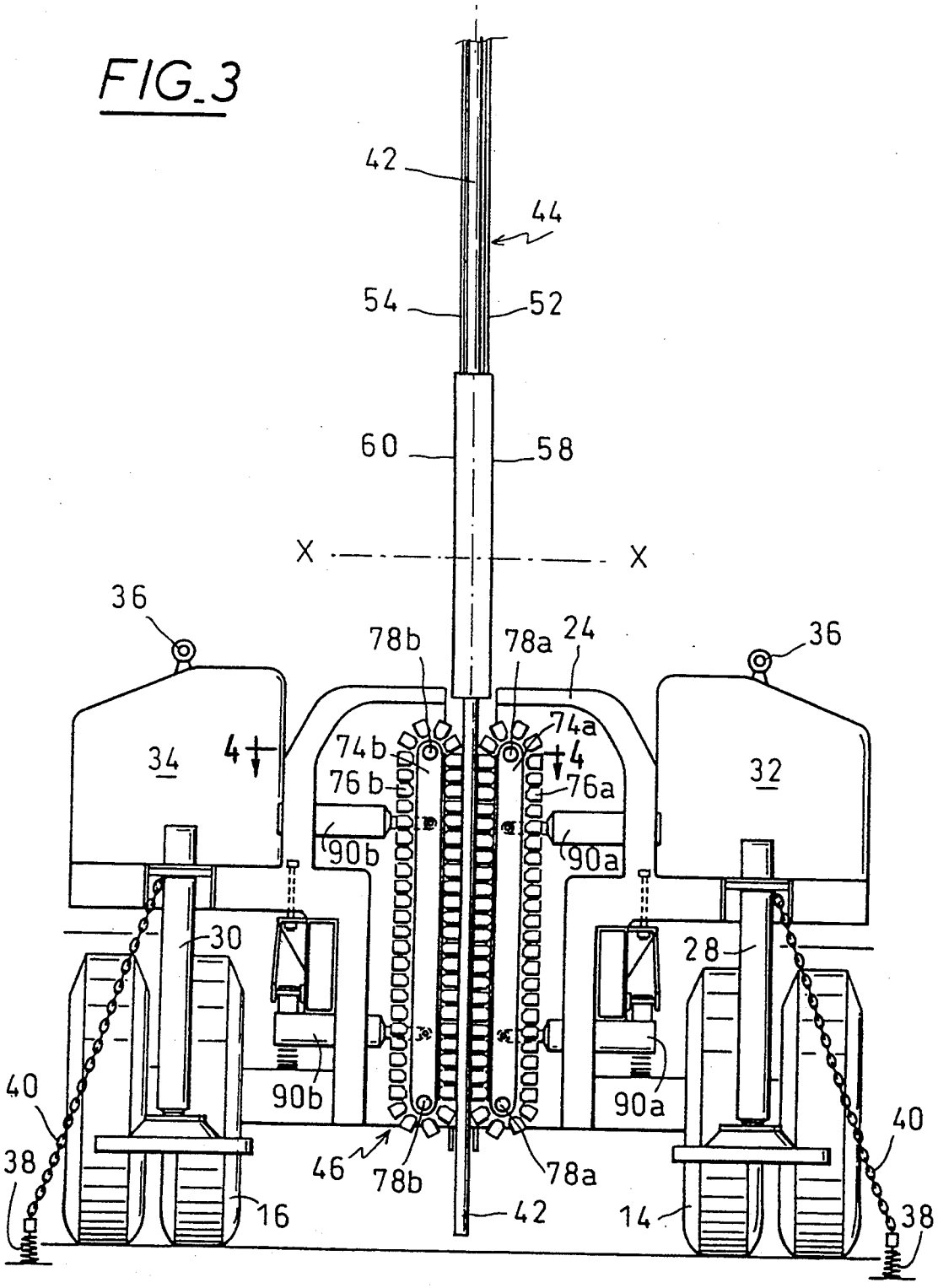
FIG. 3 is a rear.

Further, to counter the lifting force of the trailer, the latter supports two ballasts 32, 34 fixed on the right and left on the lateral extensions of the support structure. The ballasts are provided with lugs 36 which enable lifting either of the ballasts, or of the trailer by any suitable lifting device. Additionally, the trailer can be held on the ground by anchoring screws 38 screwed into the ground and connected to the chassis via guys 40 or braced chains (FIG. 3).

The driving device substantially comprises a one-piece rod 42, a winding drum 44, and a device for driving and extracting the rod, which will be described one by one in detail.

The rod 42 is made in composite material with a high resistance fiber base, such as for example glass fibers, carbon, metal or aramid, buried in a bonding material, for example a resin. Its section may be of any shape.

The rod is manufactured in one piece, with the necessary length, for example 40 m.

It is made in such a way as to have excellent resistance to traction and compression, without noticeable elongation or contraction, while enabling it to be wound by reversible elastic deformation, on a curvature radius of 1.50 m to 2 m.

Its front end 48, designed to be driven vertically into the ground, is fitted with a penetration head provided with passive or active penetration elements and appropriate sensors for measuring ground parameters.

Inside the channel of the rod, and along its full length, electric cables are arranged designed for connecting the sensors to the measuring apparatuses not shown which can also be mounted on the chassis or, if their fragility so dictates, they can be brought to the site by other means.

The drum 44 for winding the rod 42 is a narrow drum with a large diameter arranged vertically on the trailer between the two longitudinal beams 20, 22, so that its axis XX is arranged horizontally and transversely relative to the chassis.

The drum 44 comprises a cylindrical rim 50 flanked by two radial side end plates 52, 54 comprising a sort of annular gutter open towards the exterior, in which the rod 42 is wound onto several adjacent and/or superimposed turns. The cylindrical rim supports internally a rack 56 designed to be driven in rotation as will be seen afterwards.

The chassis also comprises two retaining cheeks 58, 60 secured to the support structure 24, directed substantially vertically, and separated from one another at a distance sufficient to allow the drum 44 to pass between them while guiding it laterally.

The weight of the drum 44 is sustained by two rollers (FIG. 2) held between the cheeks 58, 60: an upper roller 62 positioned substantially at the .same level as the axis of the drum 44 and in contact with the inside of the rim, in such a way that the gutter is, at that level, usually perpendicular to the transverse support structure, and a lower roller 64 placed beneath the upper roller 62 and in contact with the peripheries of the side plates 52, 54 of the drum 44.

Lateral guiding of the drum 44 is also provided in the area which separates the two longitudinal beams 20, 22.

Figure 2:
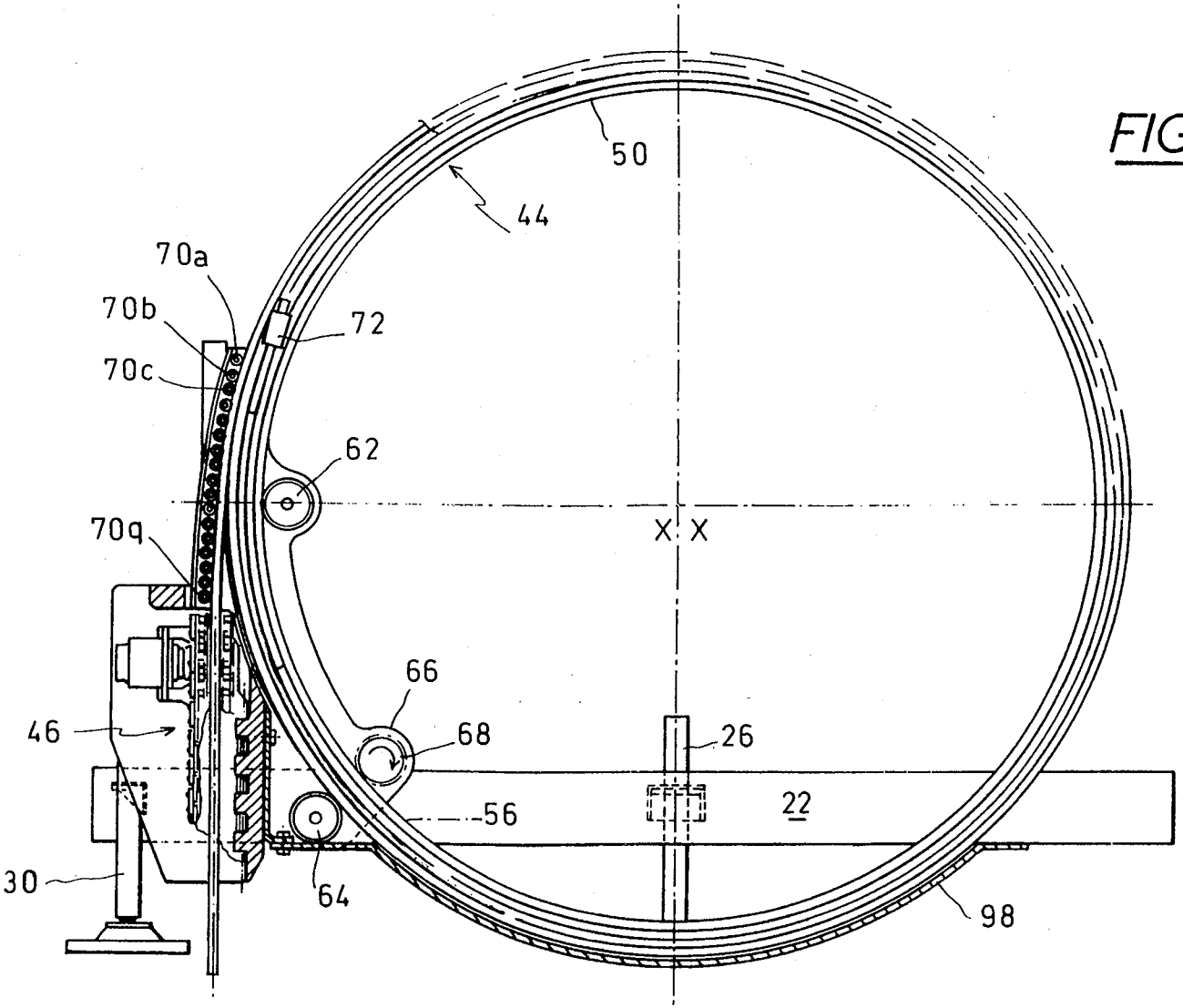
FIG. 2 is a longitudinal section view.

Facing the lower roller 64, on the inner side of the cylindrical rim 50, the cheeks 58, 60 support a winding motor 66 having a pinion gear 68 which engages with the internal rack 56 of the rim 50. The motor 66 is designed to ensure winding of the rod 42 around the drum 44. As the elastic rod 42 is wound around the drum 44 in a clockwise direction as shown in FIG. 2, the elastic forces created as the elastic rod 42 attempts to "spring back" into a linear configuration cause a counter-clockwise torque on the drum 44. Because of the counter-clockwise torque created by the spring-like elastic forces of rod 42, the motor 66 always exerts a clockwise torque on the drum 44. The winding motor 66 is controlled to vary the clockwise torque applied to the drum 44 for the various operations of winding, stopping, or unwinding the rod 42. It has been found that a hydraulic motor is suited for these functions.

It will also be noted that the cooperation between the rack 56 and the pinion gear 68 is free from radial forces, which prevents wear and the occurrence of play, and enables exact dimensioning of the elements only with the aim of transmitting the winding torque.

Substantially facing the upper roller 62, on the outer side of the drum 44, the cheeks 58, 60 support a roller train 70*a, b, c, . . . , q*, arranged successively along a line defined as being "deformed" of the rod.

More accurately, the roller train defines for the rod 42 a winding path whose curvature varies, from a curvature close to the curvature of the rim 50 of the drum 44 at the level of the first or highest roller 70*a*, to zero curvature at the level of the last or lowest roller 70*q*.

Thus, a transition zone is arranged for the rod 42 between a vertical rectilinear configuration beneath the last roller and a given curvature configuration above the last roller.

The exact arrangement of the rollers can be determined by calculation and/or experiment.

The other end 72 of the rod 42 is fixed firmly on the drum 44, for example on one of the side plates 52, 54 and outside of the latter, and the electric cable which runs through the rod 42 is extended beyond the end in a fixed connector (not shown) to which measuring instruments can be connected. Advantageously, the cable extension will be twisted, in order to withstand without damage variations in length and torsion, caused by rotation of the drum 44. As a variant, provision can be made for the fixed connector to be of the rotary type.

The device 46 for driving and extracting the rod 42 is mounted in the transverse support structure 24, along the vertical rectilinear rod part which separates the last roller 70*q* and the ground.

As illustrated in FIG. 3, the device 46 comprises two symmetrical parts which cooperate via friction on either side of the rod 42.

Each part comprises a guide support 74*a*, 74*b* elongate in shape and arranged so as to be vertically parallel to the rod 42. Endless chains 76*a*, 76*b* are adapted to be guided about the two ends of the guide supports 74*a*, 74*b* respectively by toothed return wheels 78*a*, 78*b*.

Figure 4:
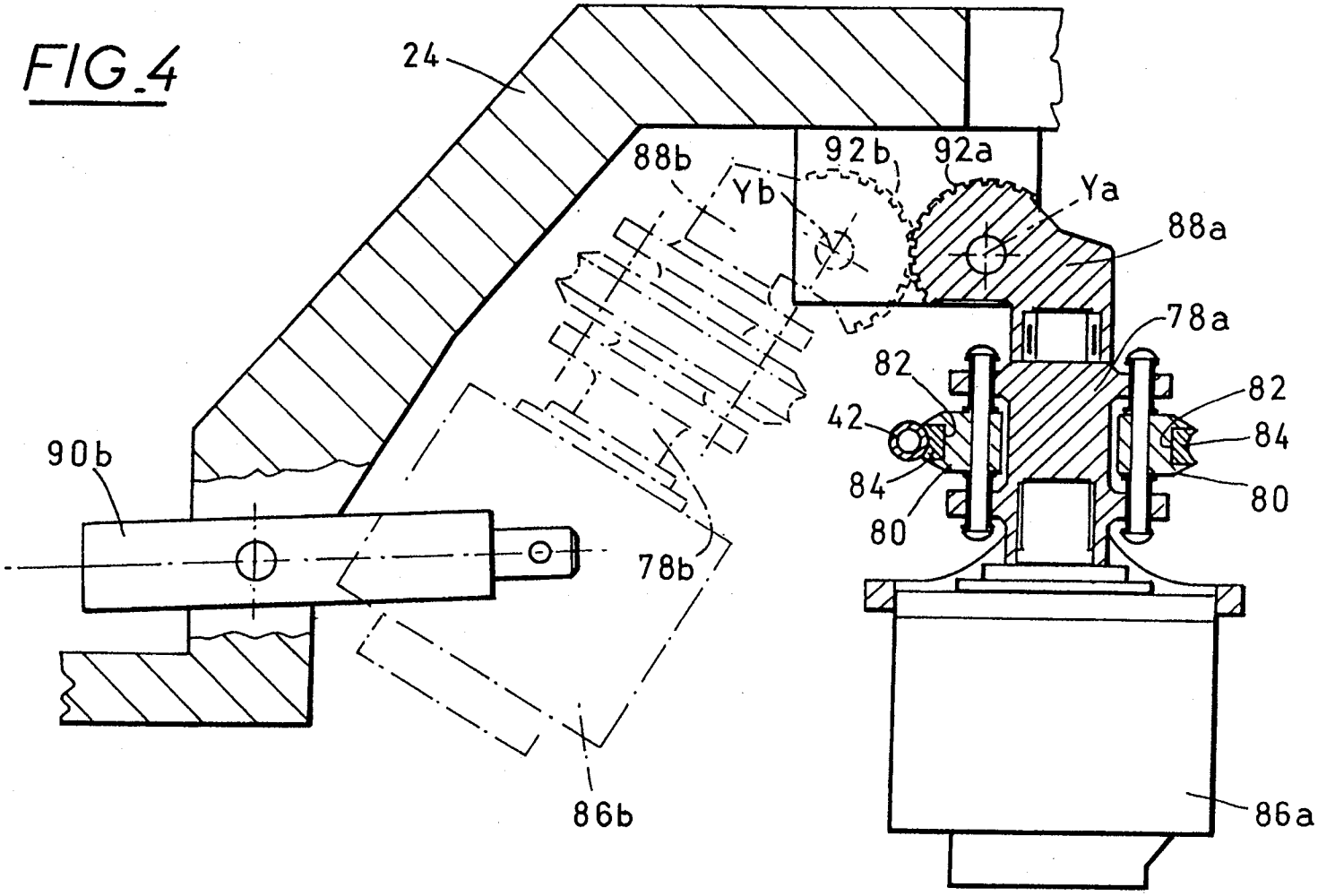
FIG. 4 is an enlarged partial section view of the driving and extracting mechanism, taken along the line 4—4 in FIG. 3.

Each of the chains 76*a*, 76*b* include a series of links 80, each of which comprises on its outer face a housing 82 in which a runner 84 is fixed made of wear-resistant material and having a high friction coefficient with regard to the material of the rod 42, as illustrated in FIG. 4

The runner 84 is externally hollow to form a complementary semi-cylindrical contact surface of the rod section.

On each guide support 74*a*, 74*b*, one of the chain wheels 78*a*, 78*b* is driven in rotation in one direction or the other by a motor 86*a*, 86*b*, likewise advantageously a hydraulic motor.

To enable disengagement of the rod 42, and also enable the two endless chains 76*a*, 76*b* to be applied against the rod 42 under a substantial radial force, the two guide supports 74*a*, 74*b* comprise arms 88*a*, 88*b* which pivot about a vertical axis Ya, Yb, such that the guide supports 74*a*, 74*b* and the chains 76*a*, 76*b* can be distanced from the rod 42 or brought closer thereto using jacks 90*a*, 90*b* which are supported on the support structure 24.

In order to ensure that the two guide supports 74*a*, 74*b* move symmetrically and hold the rod 42 without pushing it aside laterally, the arms 88A, 88*b* of the two guide supports are provided with toothed sectors 92*a*, 92*b* in reciprocal meshing.

The chassis supports a motor source 94, advantageously an internal combustion engine driving a hydraulic pump which supplies a flow of liquid under pressure to supply the different motors and jacks described above. Of course, the distribution circuit comprises the usual elements such as the reservoir, control valves, pressure-sensitive switches, control valves, as will appear necessary to the expert in the field.

The chassis lastly supports a control cabinet 96 comprising electrical, electronic or electromechanical circuits and the associated contactors necessary for controlling the operation of the various elements.

Operation is as follows:

the trailer is towed to the desired place, then unhitched;

the stabilizer stand 26, 28, 30 are deployed so as to set the trailer in the horizontal position;

where necessary, the anchoring screws 38 are screwed into the ground and the guys 40 are stretched between the screws and the chassis;

the motor source 94 is started up;

the jacks 90*a*, 90*b* of the driving and extracting device 46 are pressurized, in order to apply firmly the runners 84 of the endless chains against the rod 42;

the drive motors 86*a*, 86*b* of the driving and extracting device are fed in the direction which correponds to the driving of the rod 42;

during this time, appropriate control of the winding motor 66 enables the rod 42 to be unwound with respect to the drum 44;

when the length of rod 42 driven into the ground reaches a desired value, the drive motors of the driving and extracting device are stopped, then the pressure in the associated jacks is released.

The necessary measurements can be proceeded with in two ways: either continuously while the rod is being driven, or at a fixed point when the rod is stopped in a determined position.

If necessary, the motor source 94 can be stopped. In point of fact, only the winding motor 66 then consumes a little energy and to this end all that is required is to provide a liquid reservoir under pressure with sufficient capacity to maintain the couple preventing rotation of the drum under the "spring" effect of the rod.

When the measurements have been completed, the rod 42 is extracted:

the motor source is started up again;

the jacks of the driving and extracting device are pressurized;

the drive motors are driven in the direction which corresponds to the extraction;

the drive motors are stopped when the rod is fully extracted;

the pressure in the jacks of the driving and extracting device is then released;

throughout the extraction period, the control associated with the winding motor supplies the latter as necessary for winding the rod properly.

The guys 40 and the anchoring screws can then be withdrawn, then the stabilizer feet 26, 28, 30 raised and the trailer drawn to another site.

It is clearly obvious from the above that the device according to the invention enables the rod to be driven in in a continuous manner, practically without manual intervention by operators, in considerably less time than the prior art.

During towing and non-utilization times, a mechanical blocking element will be provided to prevent accidental unwinding of the rod 42.

Further, to prevent damage to equipment and injury, in case of fracture of the rod 42 and sudden release of the elastic energy stored via its winding, a fairing 98 will be provided in thick sheet iron, if not on the circumference of the drum 44, at least on the entire lower region beneath the two longitudinal beams 20, 22 (FIG. 2).

It will be understood that the lower channel of the rod 42 can house not only electric cables designed to transmit low power signals coming from the sensors, but also electric cables designed to distribute power to active elements in the penetration head, hydraulic or pneumatic conduits or even optic cables.

Finally, the invention advantageously provides for the rod 42 to include conductive wire indicators buried along the length of the rod in the material which comprises it, connected to an appropriate detection box.

Thus, when extracting the rod 42, if the deformation sustained locally thereby exceeds an admissible value, entailing a risk of fracturing the rod, one or more of the associated indicators break and the detection box detects such fracture and produces an alarm signal. In addition to the alarm, the detection box can imperatively bring about stoppage of the drive motors 86*a*, 86*b* of the driving and extracting device and oblige extraction and resetting manually by one of the operators.

For practical reasons, dimensions compatible with the usual road gauges will be chosen for the whole device:

less than 4 m high less than 2.50 m wide.

I claim:

1. Apparatus for driving rods used for soil mechanics tests into the ground, said apparatus comprising:

a traction and compression resistant one-piece rod, said rod being formed of a composite material including high resistant fibers and a bonding material capable of transmitting longitudinal driving and extracting forces plus being curved by reversible elastic deformation, housing along the full length thereof soil characteristic sensing means, and being provided with a penetration head for perforating the soil;

a drum for winding said rod, said drum including a cylindrical rim and two side plates forming an annular gutter open towards the exterior in which said rod is wound, the cylindrical rim supporting a central, internal rack;

a driving and extracting device for said rod;

a chassis supporting said drum; and a winding motor supported by said chassis and coupled to the internal rack on said drum for exerting on said drum a torque in the winding direction of said rod whereby said motor continuously compensates for the spring effect of said rod during the driving and extracting of said rod without generating any radial forces.

2. The apparatus defined in claim 1 wherein the soil characteristic sensing means of said rod comprises conductive wire indicators positioned inside a channel of said rod.

3. The apparatus defined in claim 1 wherein said drum includes a cylindrical rim and spaced apart side plates, and said drum is supported on said chassis by an upper roller in contact with the rim of said drum and a lower roller in contact with the side plates of said drum.

4. The apparatus defined in claim 3 wherein the rim of said drum supporting the internal rack, and said winding motor includes a pinion gear in driving engagement with the rack of said drum.

5. The apparatus defined in claim 1 including roller means for defining a winding path for said rod as said rod exits said drum wherein the winding path curvature varies from a curvature of said drum to a zero curvature.

6. The apparatus defined in claim 1 wherein said driving and extracting device comprises endless chain means including means for frictionally engaging said rod, and means for driving the chain means.

7. The apparatus defined in claim 6 wherein the means for frictionally engaging said rod includes at least two separate means engaging opposite sides of said rod.

8. The apparatus defined in claim 6 wherein the endless chain means of said driving and extracting device includes elongate guide support means for the endless chain means and means for effecting adjustment of the guide support means relative to said rod.

9. The apparatus defined in claim 6 wherein the endless chain means of said driving and extracting device includes link members formed of wear-resistent material having a high friction coefficient with respect to said rod.

10. The apparatus defined in claim 6 including a trailer provided with ground engaging wheel means.

11. The apparatus defined in claim 6 wherein said apparatus is mounted on a vehicle having ground engaging wheel means.

* * * * *